United States Patent [19]

Collins

[11] Patent Number: 4,473,057

[45] Date of Patent: Sep. 25, 1984

[54] FUEL ATOMIZER

[76] Inventor: Thomas L. Collins, Rte. 2, Box 70, Pioneer, Tenn. 37847

[21] Appl. No.: 551,955

[22] Filed: Nov. 15, 1983

[51] Int. Cl.[3] ..... F02M 23/04

[52] U.S. Cl. ..... 123/592; 48/189; 261/78 R

[58] Field of Search ..... 123/592, 590; 48/189.5; 261/78 R

[56] References Cited

U.S. PATENT DOCUMENTS

| | | | |
|---|---|---|---|
| 1,154,530 | 9/1915 | Merriam et al. | 123/592 |
| 1,348,272 | 8/1920 | Elling | 48/189.5 |
| 1,725,336 | 8/1929 | Brown | 48/189.5 |
| 1,950,586 | 3/1934 | Zubaty | 123/592 |
| 2,186,673 | 1/1940 | Hashimoto | 48/189.5 |
| 2,205,750 | 6/1940 | Ross | 123/592 |
| 2,273,957 | 2/1942 | Harrell | 48/189.5 |
| 2,319,752 | 5/1943 | Smith et al. | 123/592 |
| 2,437,183 | 3/1948 | Berg | 123/592 |
| 2,669,508 | 2/1954 | Christensen | 48/189.5 |
| 3,273,549 | 9/1966 | Deland | 123/592 |
| 3,283,482 | 11/1966 | Trafford et al. | 123/592 |
| 4,080,943 | 3/1978 | Carr | 123/592 |

*Primary Examiner*—Ethel R. Cross

*Attorney, Agent, or Firm*—Luedeka & Neely

[57] ABSTRACT

A fuel atomizer for use in an internal combustion engine is mounted on a bracket and suspended within the air intake passageway of an engine, between the carburetor and the intake manifold, to facilitate the thorough mixing of fuel and air before combustion. When air moves through the passageway, it causes the atomizer to spin, which breaks up fuel droplets and promotes efficient combustion. The atomizer has a cylindrical cage with blades disposed about and parallel to its axis of rotation and with two circular end pieces which abut the blades to form the ends of the cage. The cage is horizontally mounted on an axis of rotation by the bracket which suspends the atomizer in the air passageway.

8 Claims, 4 Drawing Figures

FUEL ATOMIZER

This invention relates generally to fuel and air mixing devices for use on an internal combustion engine and more particularly concerns fuel and air mixing devices activated by the flow of air through the intake passageway of an internal combustion engine.

Attempts to improve the internal combustion engine have been numerous. One approach to increase the efficiency of an internal combustion engine is to improve the degree to which the fuel is combined with air before combustion takes place. Many of these devices are powered externally, while others are powered by air flowing through the intake passageway or the exhaust system.

Fuel atomizers often consist of elaborate devices which contain numerous moving parts and require professional installation. Moving parts wear quickly, add to the machining and production costs for each unit and present a danger that fragments broken off during operation could enter the engine and cause damage. Professional installation also adds to the cost of each unit, and, in many cases, the presence of such devices increases the overall engine size.

Because the present invention consists essentially of one unitary moving part mounted on a unitary bracket, the dangers and inconveniences mentioned above are avoided. As hereinafter described in more detail, the device disclosed herein fulfills the need for a useful, inexpensive, easily installed, easily replaced, durable and safe means for increasing the fuel efficiency of an internal combustion engine.

The fuel atomizer of the present invention is suspended within the air intake passageway of an internal combustion engine and is generally disposed between the carburetor and the intake manifold of the engine to assure that the fuel and air in the passageway are thoroughly mixed. The atomizer has a cylindrical cage that is suspended for rotation on a unitary bracket which is mounted in the air passageway by a first mounting means. The bracket supports two opposed wheels which form the ends of the cylindrical cage, and have generally circular peripheries. These wheels share a common axis of rotation and are spaced apart within the passageway so that their planes of rotation are generally parallel to the airflow in the passageway.

A plurality of blades extends between the circular peripheries of the opposed wheels to form the sides of the cylindrical cage. The blades, having a cross sectional thickness and a width, are oriented at an angle of less than 90° with respect to a radius extending from the axis of rotation of the cage to the blades so that air moving through the passageway from the carburetor to the intake manifold impinges upon the blades and spins the cylindrical cage. The spinning cylindrical cage increases the turbulence of the air flow in the passageway and assures that the fuel is thoroughly dispersed, that large fuel droplets are atomized and that the fuel and air in the passageway are more thoroughly mixed.

In part, the durability of the present invention results from the fact that the single moving part of the invention may be formed from, essentially, a single unitary body. That is, the cylindrical cage may be formed from a single cylinder having closed ends. Saw cuts in the cylindrical walls form the blades of the cylindrical cage and, by carefully placing the cuts, uniform blades and a balanced cage are produced.

The cylindrical cage rotates on an axis of rotation that is perpendicular to airflow and, thus, the axis of rotation is usually horizontal. The cylindrical cage on this type of axis of rotation avoids the wobble problem inherent in propeller like devices having an axis of rotation parallel to the airflow.

The bracket which supports the cylindrical cage further contributes to the durability and inexpensiveness of the atomizer. The bracket is formed as a single unit from wire threaded through the cylindrical cage. Apertures are formed in the wheels to receive the bracket and act as bearings, and both ends of the bracket are secured so there is little chance that failure of the bracket will release the cage to fall into the engine. Also, because the bracket is wire, it may be installed in many different engines. The length of the bracket may be adjusted by cutting the bracket wire and reforming (bending) the ends to form mount segments thereon.

In one embodiment of the present invention, the blades forming the sides of the cylindrical cage have a cross-sectional shape generally in the form of a truncated parallelogram with two opposed planar surfaces along the width of each blade. Because of the truncation the opposed surfaces are slightly inclined, one with respect to the other, and the blades are thicker at their outermost edge than at their inner edge. A convex outer surface formed on the outermost edge of the blades defines the blades' outer width, while a concave inner surface formed on the interior edges of the blades defines their inner most width.

In this embodiment of the present invention, the bracket which supports the cylindrical cage is mounted in the air passageway by a first mounting means comprised of a thin member which extends outwardly from the bracket and is dimensioned to fit beneath the carburetor when the carburetor is mounted on the engine. The end of the member is fashioned in a generally circular arrangement so that the member encircles at least one of the bolts used to mount the carburetor onto the engine.

The bracket also has a transverse portion which is substantially perpendicular to the general flow of air through the passageway and at least one leg portion which extends between the transverse portion and the first mounting means and is substantially parallel to the general flow of air in the passageway.

The present invention may best be understood by reference to the following detailed description of a preferred embodiment when considered in conjunction with the drawings in which.

Figure 1:
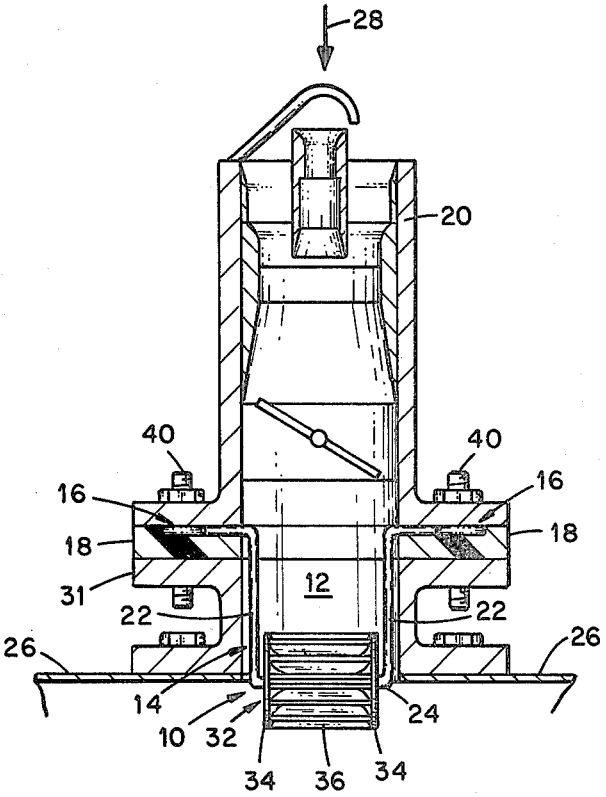
FIG. 1 is a cut away view of the device disposed within the air intake passageway of an internal combustion engine generally between the carburetor and the intake manifold.

Referring now to the drawings in which like reference characters designate like or corresponding parts throughout the several views, there is shown in FIG. 1 a somewhat diagrammatical, cut away, view of an atomizer 10 suspended within the air intake passageway 12 of an internal combustion engine. The atomizer 10 is suspended on a bracket 14 which is mounted in the air passageway by mounting segments 16 that extend outwardly from the bracket for being secured between a gasket 18 and a carburetor 20. The bracket includes two legs 22 and a transverse portion 24 which suspend the atomizer 10 within the air intake passageway 12 generally between the carburetor 20 and an intake manifold 26. The legs 22 of the bracket 14 each extend between one of the mounting segments 16 and the transverse portion 24 and are substantially parallel to the general flow of air through the passageway as represented by arrow 28. The transverse portion 24, which extends between the legs 22 and supports the atomizer 10 for rotation, is substantially perpendicular to the general flow of air in the passageway 12.

Figure 2:
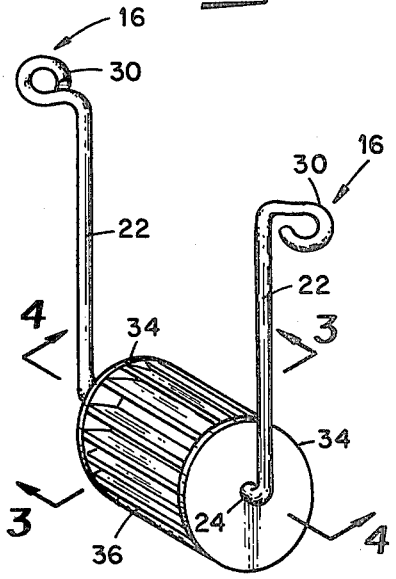
FIG. 2 is a perspective view of the device.

Preferably, the bracket 14 is formed from a single length of wire and is bent and formed into the various portions and segments herein described. Though the illustrated embodiment includes a bracket with two legs 22, each supported by a first mounting segment 16, other embodiments may include at least one leg 22 and at least one mounting segment 16. As shown in FIGS. 2 and 1, the first mounting segments 16 are fashioned into a loops 30 so as to accommodate bolts 29 passing through the carburetor 20 to mount the carburetor 20 on the engine 31. Other embodiments may include first mounting segment 16 without a loop 30 but with other appropriate structure to support the bracket within the air passageway 12.

The atomizer 10 includes a cylindrical cage 32 which is supported for rotation on the bracket 14. The cage 32 includes two opposed wheels 34 which are spaced apart and oriented in planes that are generally parallel to the flow of air 10 in the passageway 12. These wheels 34 have a generally circular periphery and include apertures 38 which serve as bearings to carry the cage 32 on the bracket 14.

The wheels 34 form the ends of the cylindrical cage 32, while a series of blades 36 extending between the periphery of each wheel 34 forms the sides of the cylindrical cage. These blades 36 are pitched at angles so that air moving through the passageway impinges upon the blades 36 and causes the cage 32 to spin about the transverse member 24. This spinning motion increases the air turbulence in the passageway and promotes the mixing of fuel and air.

The cage 32 is formed by cutting slots in an aluminum tube or cylinder to form the blades 36. The tube is cut longitudinally leaving a small portion of the original cylinder on either end of the cylindrical tube. The opposed wheels 34 are formed by welding aluminum disks on the ends of the cut cylinder. The disks are preferably sized with the same outside diameter as the tube to fit on the end of the cylinder, but they may have a diameter equal to the inside diameter of the cage 32 and, in such case, they are welded flush within the outside ends of the cylinder.

The opposed wheels 34 have apertures 38 at their centerpoints and comprise circular discs of about one inch in diameter. In this embodiment, the blades 36 are about one inch in length, about three-eights inch in width and are inclined at an angle of about thirty degrees with respect to a radius extending perpendicularly from the axis of rotation of the cage 32 to one of the blades 36. The distance between the opposing planar surfaces of adjacent blades 36 is about one-eight inch and the thickness of the blades 36 measured at the outer edge is about one-sixteenth inch. Preferably, the cage is constructed of aluminum and the bracket is constructed of steel or stainless steel wire.

Referring now to FIG. 2 which represents a perspective view of the device, the angular disposition of the blades 36 is more clearly apparent. The blades 36 extend between the periphery of the opposed wheels 34, which in this embodiment are supported for rotation on the transverse portion 24 of the bracket.

Figure 3:
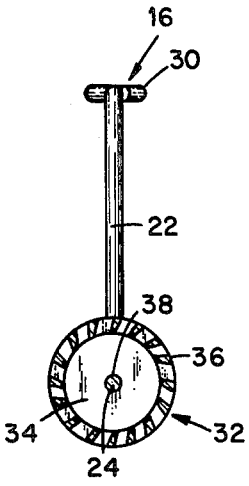
FIG. 3 is a first cross sectional view of the device taken along line 3—3 of FIG. 2.

Referring now to FIG. 3 which represents a cross-sectional view of the preferred embodiment of the atomizer 10 taken along line 3—3 of FIG. 2, the shape of the blades 36 is more clearly apparent. A convex outer surface forms the outer edge of each blade 36 while the inner edge of each blade 36 has a concave surface. The side of each blade 36 is generally parallel to the side of an adjacent blade 36 so that the shape of each individual blade 36 is somewhat truncated. That is, the blade 36 is slightly thicker at its outer edge and the sides of each blade 36 are inclined slightly one with respect to the other.

Figure 4:
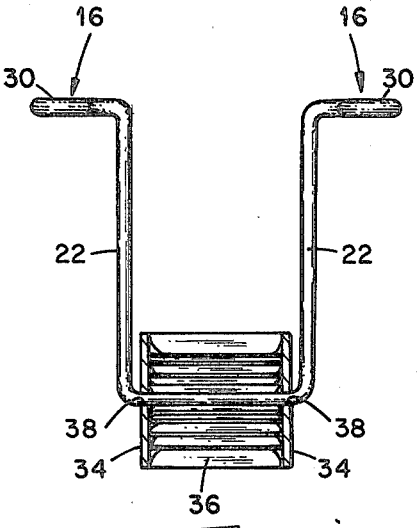
FIG. 4 is a second cross sectional view of the device taken along line 4—4 of FIG. 2.

Referring now to FIG. 4 which represents a cut away view of the device taken along line 4—4 of FIG. 2, the manner in which the transverse portion 24 of the bracket supports the opposed wheels 34 for rotation is shown. The blades 36 extend between the peripheries of the wheels 34 to form the cylindrical cage 32, and the transverse portion 24 of the bracket 14 extends through apertures 38 in each wheel 34 and through the center of the cage 32. When moving air impinges on the blades 36, the apertures 38 act as bearings and the cage 32 spins on the axis defined by the transferse portion 24. Because the bracket 14 is a single piece and is secured at both ends by loops 30, there is no danger that bending or other deformation of the bracket will release the cage 32. Thus, the danger of failure and dropping the cage 32 into the intake manifold is minimized.

Because the bracket 14 is made of wire it may be installed in numerous different engines by simply cutting and reforming the bracket. Installation begins with measuring the distance from the gasket 18 to the bottom of the air passageway 12. Then the leg portions 22 are bent about ninety degrees to form leg portions 22 of a sufficiently short length to support the cage 32 above the bottom of air passageway 12. Loops 30 are formed in the wire in a plane generally perpendicular to the leg portions 22 and they serve two purposes. The loops 30 encircle the bolts 40 that hold the carburetor 20 on the engine to prevent the mounting member from slipping out of the clamp between the gasket 16 and the carburetor 20, and the loops 30 rigidly hold the leg portions 22 to prevent the leg portions from swinging in a plane parallel to the airflow in passageway 12. After the loops 30 are formed, excess wire is cut away.

Although a preferred embodiment is described above, it will be understood that the invention is capable of numerous modifications, rearrangements and substitutions of parts without departing from the scope of the invention as defined in the claims.

What is claimed is:

1. A fuel atomizing apparatus for operation within the air intake passageway of an internal combustion engine to facilitate mixing of fuel and air in the passageway, the device being disposed generally between a carburetor and an intake manifold and comprising:

a bracket for suspending the device within the air intake passageway of the internal combustion engine generally between the carburetor and the intake manifold;

first mounting means for fixedly mounting said bracket in the air passageway;

a cylindrical cage rotatably mounted on said bracket and comprising:

two opposed wheels disposed in a spaced apart relationship within the air passageway and being oriented in planes that are generally parallel to the air flow within the passageway, said wheels each having a generally circular periphery;

second mounting means for rotatably mounting each of said wheels for rotation about a common axis; and a plurality of blades extending between the periphery of said wheels to form the cylindrical cage, said blades having a cross sectional width and thickness with the width of each of said blades being oriented at an inclination angle of less than 90 degrees with respect to a radius extending from the axis of rotation of said wheels to said blades so that air moving in said passageway from the carburetor to the intake manifold will impinge upon said blades and spin the cylindrical cage, whereby said blades will increase the turbulence of the air flow and will increase the dispersion, mixing and atomization of fuel in the air flow.

2. The fuel atomizing apparatus of claim 1 wherein said blades have a cross sectional shape generally in the form of a truncated parallelogram with two opposed planar surfaces along the width of each of said blades, a convex outer surface formed on the outer edges of said blades at their outermost surfaces, and concave inner surfaces formed on the interior edges of said blades and defining the thickness of said blades at their innermost surfaces.

3. The fuel atomizing apparatus of claim 1 wherein said opposed wheels of said cage are comprised of circular discs mounted on said bracket substantially at their centerpoints.

4. The apparatus of claim 1 wherein said blades are inclined at an angle of about thirty degrees with respect to a radius extending perpendicularly from the axis of rotation of said cage to said blades.

5. The apparatus of claim 1 wherein said blades are spaced apart, one from the other, at a distance of about one-eighth inch and have a thickness at the outer edges of the blades of about one sixteenth inch.

6. The apparatus in claim 1 wherein said first mounting means comprises at least one thin member extending outwardly from the bracket and dimensioned to fit beneath the carburetor when the carburetor is mounted on the internal combustion engine.

7. The apparatus of claim 1 wherein said bracket and first mounting means comprise:

a transverse portion that is disposed substantially perpendicularly to the general flow of air in the intake passageway and is positioned generally between the carburetor and the intake manifold;

two leg portions that are disposed substantially parallel to the flow of air in the intake passageway and extend between said transverse portion and said first mounting means, one leg portion extending from each end of said transverse portion; and leg mounting means extending outwardly from the ends of said leg portions of said bracket for fixedly mounting both ends said bracket within the air intake passageway, whereby said bracket is constructed as a single unit with both ends thereof fixedly mounted so that deformation of the bracket will not release said cylindrical cage and the possibility of failure is minimized.

8. A method for constructing a fuel atomizer in an internal combustion engine having an air intake passageway and a carburetor mounted on the engine with bolts adjacent to the air intake passageway, comprising:

cutting a plurality of inclined slots in the walls of a metal cylinder to form a plurality of blades along the periphery of the cylinder inclined at an angle of less than ninety degrees with respect to a radius of the cylinder;

forming a closed cylindrical cage by mounting disks on the ends of the cylinder;

forming apertures in the center of the disks;

threading a wire through the apertures in the disks and through the cage;

bending the wire adjacent to the apertures to form a transverse segment extending through the cage and two legs extending away from the ends of the transverse segment at about right angles with respect to the transverse segment;

measuring the distance from the bottom of the air passageway to the position where the carburetor is mounted on the engine;

bending the legs to form mount segments so that the distance from the mount segments to the furthermost position on the cage is less than the distance from the bottom of the air passageway to the position where the carburetor is mounted on the engine; and fixedly securing the mount segments between the carburetor and the engine to mount the cage in the air passageway downstream from the carburetor, whereby the airflow in the air passageway spins the cage to disburse and atomize fuel in the air.

* * * * *